US007377086B2

(12) United States Patent
Cremers et al.

(10) Patent No.: US 7,377,086 B2
(45) Date of Patent: May 27, 2008

(54) TACO SHELL NESTING APPARATUS AND METHOD

(75) Inventors: Thomas G. Cremers, Paynesville, MN (US); Craig Gustafson, Bloomington, MN (US); Ralph Stenvik, Coon Rapids, MN (US)

(73) Assignee: General Mills, Inc., Minneapolis, MN (US)

( * ) Notice: Subject to any disclaimer, the term of this patent is extended or adjusted under 35 U.S.C. 154(b) by 0 days.

(21) Appl. No.: 11/445,281

(22) Filed: Jun. 2, 2006

(65) Prior Publication Data

US 2006/0213149 A1 Sep. 28, 2006

Related U.S. Application Data

(62) Division of application No. 10/657,583, filed on Sep. 8, 2003.

(51) Int. Cl.
*B65B 61/00* (2006.01)
*B65B 35/30* (2006.01)

(52) U.S. Cl. ..... 53/415; 53/448; 53/537; 53/135.1

(58) Field of Classification Search ..... 426/128, 426/438, 439; 271/99, 132, 145, 160; 53/135.1, 53/147, 537, 542, 543, 415, 443, 448; 198/418, 198/418.9, 419.1, 792, 419.2; 99/404, 450.6
See application file for complete search history.

(56) References Cited

U.S. PATENT DOCUMENTS 2,294,273 A * 8/1942 Buxbaum ..... 271/99
2,928,672 A 3/1960 Johnson et al.
3,766,846 A * 10/1973 Jimenez ..... 99/404
3,797,822 A * 3/1974 Anderson ..... 271/99
3,937,458 A * 2/1976 Langen ..... 271/99
4,160,043 A * 7/1979 Stickle et al. ..... 426/439
4,510,165 A * 4/1985 Caridis et al. ..... 426/439
4,513,559 A 4/1985 Herrington, Jr.
4,530,200 A 7/1985 Prewer
4,553,370 A 11/1985 Anderson et al.
4,554,865 A * 11/1985 Caridis et al. ..... 99/404
4,607,832 A 8/1986 Abe
4,750,743 A 6/1988 Nicoletti
4,753,336 A * 6/1988 Taylor et al. ..... 198/419.1

(Continued)

*Primary Examiner*—Louis Huynh
(74) *Attorney, Agent, or Firm*—John A. O'Toole; Douglas J. Taylor; Everett Diedriks

(57) ABSTRACT

The present invention is, in one embodiment, an apparatus for placing an insert within a nested group of taco shells. The insert placement apparatus comprises a vertical shaft, a horizontal shaft, a first pillow block, a second pillow block, a vacuum cup, a horizontal timing belt, an air cylinder, and a servomotor. The vacuum cup is adapted to transport the insert. The first pillow block has a bore therethrough for receiving the horizontal shaft. The second pillow block is supported off of the first pillow block and has a bore therethrough for receiving the vertical shaft. The vacuum cup is suspended off of the vertical shaft. The horizontal belt is routed around a drive pulley and a second pulley and is interconnected to the first pillow block. The servomotor is interconnected to the drive pulley. The servomotor causes the timing belt to displace the first pillow block along the horizontal shaft, thereby causing the vacuum cup to displace horizontally. The air cylinder is adapted to vertically displace the vertical shaft through the second pillow block. This causes the vacuum cup to displace vertically.

7 Claims, 12 Drawing Sheets

U.S. PATENT DOCUMENTS 4,760,775 A * 8/1988 Hoskins ..... 99/404
5,092,577 A 3/1992 Schmitz et al.
5,271,709 A * 12/1993 VanderMeer et al. .... 198/419.1
5,300,011 A 4/1994 Budde et al.
5,326,577 A * 7/1994 Warnock ..... 426/128
5,531,156 A * 7/1996 Brummett ..... 99/450.6
5,551,333 A * 9/1996 Goto et al. ..... 99/450.6
6,000,524 A * 12/1999 Vetruba ..... 198/416
6,217,276 B1 * 4/2001 Hohmann et al. ..... 53/542
6,254,522 B1 7/2001 Schmidt, V
6,458,396 B1 * 10/2002 Hirst ..... 426/128

* cited by examiner

10

TACO SHELL NESTING APPARATUS AND METHOD

CROSS-REFERENCE TO RELATED APPLICATIONS

This application represents a divisional of U.S. patent application Ser. No. 10/657,583 filed Sep. 8, 2003, pending.

BACKGROUND OF THE INVENTION

The present invention relates to apparatus and methods for packaging food products. More specifically, the present invention relates to apparatus and methods for packaging taco shells.

The present taco shell nester apparatus or systems nest individual taco shells within each other to form groups of nested taco shells. The present taco nester also forms insert flats or coupons into spacer inserts and places the formed spacer inserts into the open end of the nested taco group and advances the group with spacer to subsequent packaging operations.

Taco shells are typically formed by frying soft tortillas and folding into a generally crescent shape while still warm and pliable. The taco shells so formed are often nested into groups comprising from 2-20 individual taco shells. Popular packaged food items comprise six, 10, 12 or 18 count groups. Common commercial practice still involves manual nesting of individual taco shells into nested groupings of desired numbers of shells. However, automated or mechanized apparatus for nesting shells are known and commercially employed. Such prior nester systems, however, are not easily converted from producing six count groups to producing for example, 12 or 18 count groups, or vice versa. Also, prior nester systems generally employ numerous pneumatic cylinders for operation that require significant amounts of maintenance and part replacement that results in considerable process downtime, use large amounts of compressed air that results in expensive operational costs, have less than desirable production speeds, and have less than desirable operating performance with square paper inserts.

There is a need in the art for a taco shell nester system and methods that facilitate easy conversion between counts. Also, the is a need in the art for a taco shell nester system and methods that offer reduced maintenance, lower operational costs, increased production speeds, greater reliability and improved performance with square paper inserts.

BRIEF SUMMARY OF THE INVENTION

The present invention, in one embodiment, resides in apparatus for folding an insert for placement within the opening of a taco shell. The folding apparatus comprises a first pivot shaft, a second pivot shaft, a frame, a first lever arm, a second lever arm, a first folder finger, and a second folder finger. The first and second pivot shafts are pivotally connected to the frame. The first lever arm is perpendicularly connected to the first pivot shaft, and the second lever arm is perpendicularly connected to the second pivot shaft. The first folder finger is perpendicularly connected to the first pivot shaft, and the second folder finger is perpendicularly connected to the second pivot shaft. Each folder finger is adapted to the insert as it passes the folder fingers.

In one embodiment, the folding apparatus further comprises a cam follower pivotally connected to the free end of each lever arm. The axis of the cam follower and the axis of the pivot shaft are parallel.

In one embodiment, the folding apparatus further comprises a spring having a first end and a second end. The first end is connected to the first lever arm and the second end is connected to the second lever arm.

In one embodiment, the folding apparatus further comprises an insert magazine connected to the frame. The insert magazine comprises a channel and a slide block. The slide block has an angled leading face and is adapted to slidably displace within the channel. The channel is adapted to receive inserts.

The present invention, in another embodiment, is an apparatus for placing an insert within a nested group of taco shells. The insert placement apparatus comprises a horizontal shaft and a vacuum cup. The vacuum cup is adapted to transport the insert and is supported off of a first pillow block having a bore therethrough for receiving the horizontal shaft.

In one embodiment, the insert placement apparatus further comprises a horizontal timing belt and a servomotor. The belt is routed around a drive pulley and a second pulley and interconnected to the first pillow block. The servomotor is interconnected to the drive pulley. The servomotor causes the timing belt to displace the first pillow block along the horizontal shaft, thereby causing the vacuum cup to displace horizontally.

In one embodiment, the insert placement apparatus further comprises a vertical shaft and a second pillow block. The second pillow block is supported off of the first pillow block and has a bore therethrough for receiving the vertical shaft. The vacuum cup is suspended off of the vertical shaft.

In one embodiment, the insert placement apparatus further comprises an air cylinder adapted to vertically displace the vertical shaft through the second pillow block. This causes the vacuum cup to displace vertically.

In one embodiment, the insert placement apparatus further comprises a cam supported off of the first pillow block. The cam is adapted to open a pair of folder lever arms.

The present invention, in another embodiment, is an apparatus for nesting individual taco shells to form a nested group of taco shells. The nesting apparatus comprises a nester conveyor and a first sensor. The nester conveyor is adapted to transport taco shells to a taco shell nesting station. The nester conveyor has a first operational speed and a second operational speed. The first operational speed is greater than the second operational speed. The first sensor is adapted to detect the passage of taco shells traveling to the nesting station. The nester conveyor shifts from the first operational speed to the second operational speed when the passage of a predetermine number of taco shells has been detected by the first sensor.

In one embodiment, the nesting apparatus further comprises a second sensor. The second sensor is adapted to detect the passage of the nested group from the nesting station. The nester conveyor shifts from the second operational speed to the first operational speed when the passage of the nested group has been detected by the second sensor.

In one embodiment, the nesting apparatus further comprises an infeed conveyor. The infeed conveyor is adapted to feed taco shells to the nester conveyor. The operational speed of the infeed conveyor is less than the first operational speed of the nester conveyor.

The present invention, in another embodiment, is an apparatus for aligning a nested group of taco shells. The aligning apparatus comprises a convergence volume, a pair of opposed vertical surfaces, and a structure. The convergence volume is adapted to hold the nested group of taco shells. The two opposed vertical surfaces form two sides of the convergence volume and are adapted to converge towards each other to align the nested group of taco shells. The structure is located above the convergence volume and is adapted to limit the vertical travel of the nested group of taco shells as aligning occurs.

In one embodiment, the aligning apparatus the structure is a vertically oriented plate. A bottom edge of the plate is adapted to contact the nested group of taco shells.

In one embodiment, the aligning apparatus further comprises a vertical surface forming a third side of the convergence volume. The vertical surface is adapted to pivot to become a non-vertical surface.

The present invention, in another embodiment, is an insert adapted to be placed in a folded configuration and to be inserted within an opening of a taco shell by a vacuum cup. The insert comprises a first planar surface, a second planar surface, a first arcuate fold line, and a second arcuate fold line. The first planar surface is adapted to become the outer surface of the insert when the insert is in the folded configuration. The second planar surface is adapted to become the inner surface of the insert when the insert is in the folded configuration. The arcuate fold lines are located on the first planar surface. The vacuum cup contacts the first planar surface between the arcuate fold lines. In one embodiment, the arcuate fold lines are cuts in the first planar surface. In one embodiment, the first surface is coated with a coating that facilitates adherence of the vacuum cups to the insert. In one embodiment, the coating is an oleophobic coating.

The present invention, in another embodiment, is a method for placing an insert within an open end of a taco shell. The insert placement method comprises removing with a vacuum cup the insert from a folding assembly of an insert magazine, wherein the vacuum cup moves in a first direction horizontally at a first speed. The insert placement method also comprises moving the vacuum cup horizontally in the first direction at a second speed that is greater than the first speed, after the insert has been removed from the insert assembly.

In one embodiment, the insert placement method further comprises horizontally moving the vacuum cup in a second direction at a third speed to approach the insert presented at the folding assembly. The third speed is at least equal to the first speed.

In one embodiment, the insert placement method further comprises moving the vacuum cup vertically. In one embodiment, the insert placement method further comprises the vacuum cup horizontally in a second direction. In one embodiment, the insert placement method further comprises inserting the insert within the open end of the taco shell.

The present invention, in another embodiment, is a method for nesting individual taco shells to form a nested group of taco shells. The nesting method comprises operating a nester conveyor at a first speed, sensing the passage of individual taco shells being transported to a nesting station, and causing the nester conveyor to operate at a second speed after having sensed a predetermined number of taco shells. The second speed is less than the first speed.

In one embodiment, the nesting method further comprises sensing the passage of the nested group from the nesting station. In one embodiment, the nesting method further comprises causing the nester conveyor to shift from the second operational speed to the first operational speed when the passage of the nested group from the nesting station has been sensed. In one embodiment, the nesting method further comprises operating an infeed conveyor, which is adapted to feed taco shells to the nester conveyor, at an operational speed that is less than the first operational speed of the nester conveyor.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive.

DETAILED DESCRIPTION

Figure 1:
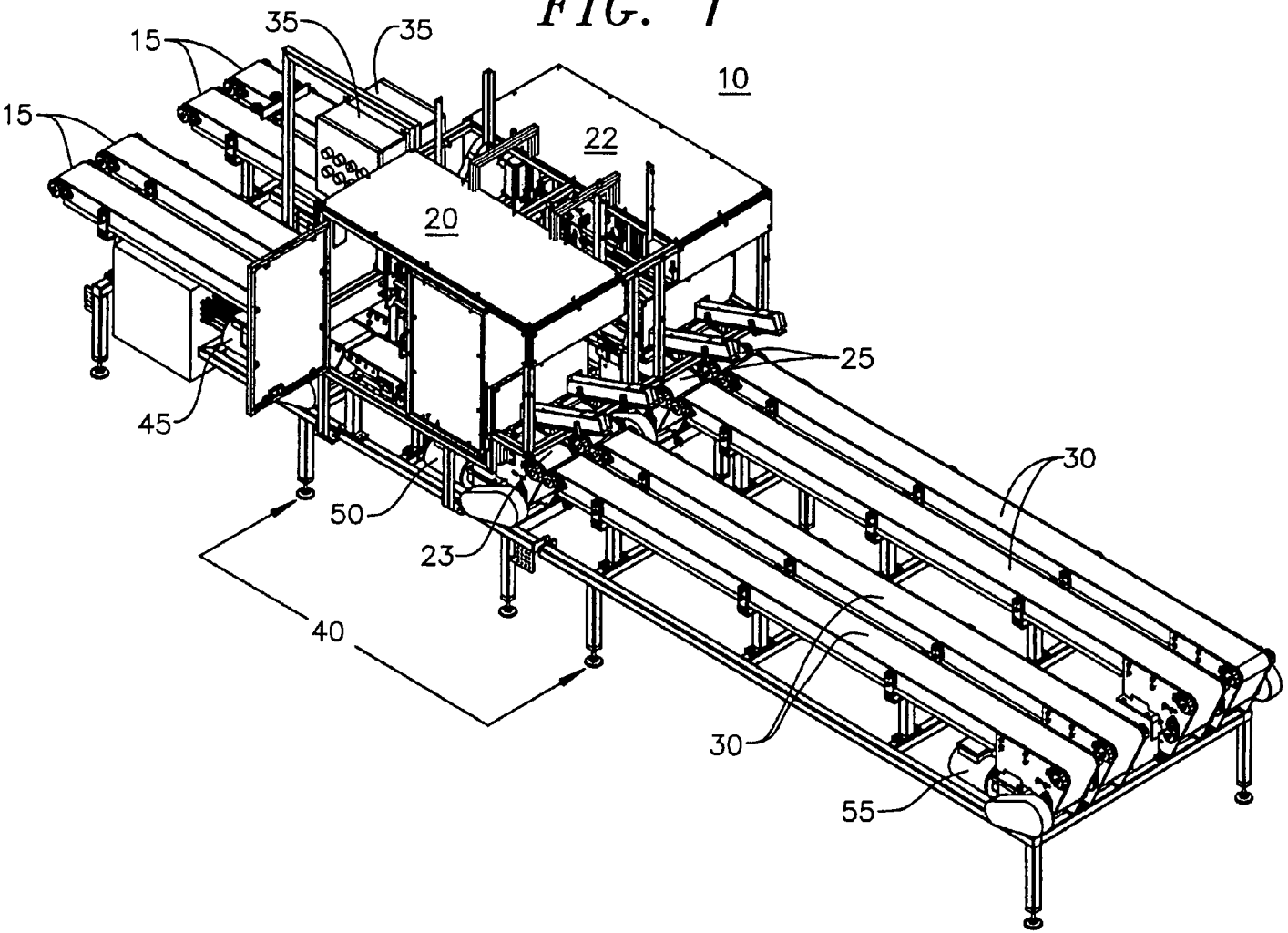
FIG. 1 is a top, front isometric view of a main assembly for the taco nester system of the subject invention.

FIG. 1 depicts a main assembly 10 for the taco nester system of the present invention. As shown in FIG. 1, in one embodiment of the invention, the main assembly 10 can include four in-feed belts 15, a first nester assembly 20 substantially enclosed within a cabinet, a second nester assembly 22 substantially enclosed within a cabinet, four nester belts 25, four takeaway belts 30, two control panels 35, and a frame system 40. In other embodiments of the invention, the main assembly 10 will have a greater or lesser number of each type of belt 15, 25, 30 and a greater or lesser number of nester assemblies 20, 22.

As indicated in FIG. 1, each in-feed belt 15 is powered by an in-feed belt motor 45, which, in one embodiment of the invention, is controlled by a variable frequency drive ("VFD"). Similarly, each nester belt 25 is powered by a nester belt motor 50, which, in one embodiment, is controlled by a VFD. Finally, each takeaway belt 15 is powered by a takeaway belt motor 55, which, in one embodiment, is controlled by a VFD. In other embodiments of the invention, the motors 45, 50, 55 may not be VFD equipped, their operational speed being controlled or set by other means known to those skilled in the art.

In operation, the in-feed belts 15 transport taco shells from left to right in FIG. 1 away from a fryer (not shown) to the nester belts 25 of the nester assemblies 20, 22 with closed ends facing downstream. As the taco shells travel on the nester belts 25 through the nester assemblies 20, 22, the nester assemblies 20, 22 nest two or more taco shells in preparation for packaging. Once nested, the taco shells leave the nester assemblies 20, 22 as groups of nested taco shells, transferring from the nester belts 25 to the takeaway belts 30. The takeaway belts 30 then transport the nested taco shells to packaging.

Figure 2:
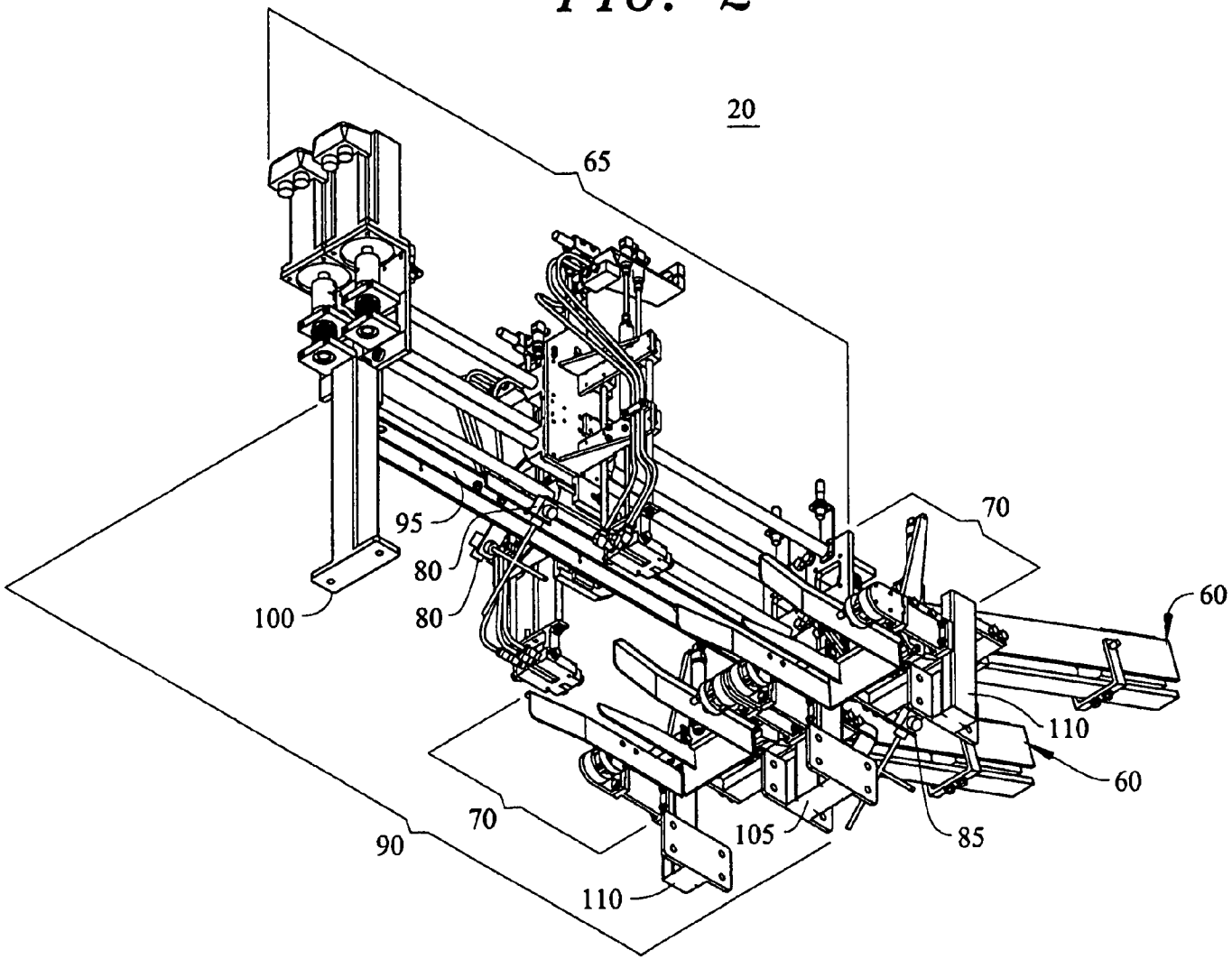
FIG. 2 is a bottom, rear isometric view of a nester assembly with its cabinet and nester belts removed.

To describe the main parts of the nester assemblies 20, 22, reference is now made to FIG. 2, which is a bottom, rear isometric view of the first nester assembly 20 with its cabinet and nester belts 25 removed. FIG. 2 depicts the second nester assembly 22 with its cabinet and nester belts 25 removed for ease of illustration.

As shown in FIG. 2, in one embodiment of the invention, the nester assembly 20 includes a pair of insert magazines 60, a pair of insert transport assemblies 65, a pair of squeeze gate/stop flap assemblies 70 (i.e., nesting stations), a rearward pair of photo switches 80, a forward pair of photo switches 85, and a nester frame 90. While the aforementioned magazines 60, assemblies 65, 70, and photo switches 80, 85 are described as being in pairs, those skilled in the art will realize that other embodiments of the invention may have a greater or lesser number of the aforementioned items.

As illustrated in FIG. 2, the nester frame 90 has a center support rail 95, a rearward support 100, a forward support 105, and outside supports 110. The top end of the rearward support 100 is connected to the rearward end of the center support rail 95, and the bottom end of the rearward support 100 has a plate for securing the rearward support 100 to the frame system 40 of the main assembly 10 or to the floor of the processing area. The top end of the forward support 105 is connected to the forward end of the center support rail 95, and the bottom end of the forward support 105 has one or more plates for securing the forward support 105 to the frame system 40 of the main assembly 10 or to the floor of the processing area. The top ends of the outside supports 110 are indirectly connected to the forward end of the center support rail 95 via frame work, and the bottom ends of the outside supports 110 have plates for securing the outside supports 110 to the frame system 40 of the main assembly 10 or to the floor of the processing area.

As indicated in FIG. 2, an insert magazine 60 is located on each side of the center support rail 95, forward of the forward and outside supports 105, 110. The nester frame 90 supports each insert magazine 60.

As shown in FIG. 2, squeeze gate/stop flap assemblies 70 are located on both sides of the center support rail, rearward of the forward and outside supports 105, 110. The nester frame 90 supports the squeeze gate/stop flap assemblies 70.

As illustrated in FIG. 2, an insert transport assembly 65, a rearward photo switch 80, and a forward photo switch 85 are located on each side of the center support rail 95. Each insert transport assembly 65 is interposed between the forward and rearward ends of the center support rail 95 and supported by the nester frame 90.

As will become more clear later in this specification, as taco shells travel along a nester belt 25 with their open end facing opposite to the belt's travel direction (i.e., the open end of the taco shell faces upstream and the closed end faces downstream), they pass under a rearward photo switch 80, which signals the passage of a taco shell to the nester logic center in the control panel 35. The taco shells continue traveling along the nester belt 25 and begin to accumulate at the squeeze gate/stop flap assembly 70, which is depicted in its downward or stop position and arrests their forward progress. As the taco shells accumulate at the squeeze gate/stop flap assembly 70, the insert transport assembly 65 removes an insert from the insert magazine 60. Once the nester logic center has determined that a sufficient number of taco shells have passed the rearward photo switch 80, the insert transport assembly 65 pursues the last taco shell with the insert, placing the insert into the open end of the last taco shell and causing the taco shells to nest within each other as the insert transport assembly 65 forces the accumulated taco shells against the squeeze gate/stop flap assembly 70. As the taco shells nest, the squeeze gate/stop flap assembly 70 squeezes together to square the group of nested taco shells laterally align. The squeeze gate/stop flap assembly 70 then moves upward to its open position, releasing the squared group of nested taco shells to move along the nester belt 25 towards the takeaway belt 30. Once the group of nested taco shells has left the squeeze gate/stop flap assembly 70 behind, the group passes the forward photo switch 85, which signals to the nester logic center that the group has cleared the squeeze gate/stop flap assembly 70. The squeeze gate/stop flap assembly 70 then moves to its downward or closed position and the cycle repeats as taco shells again begin to accumulate at the squeeze gate/stop flap assembly 70.

Figure 3:
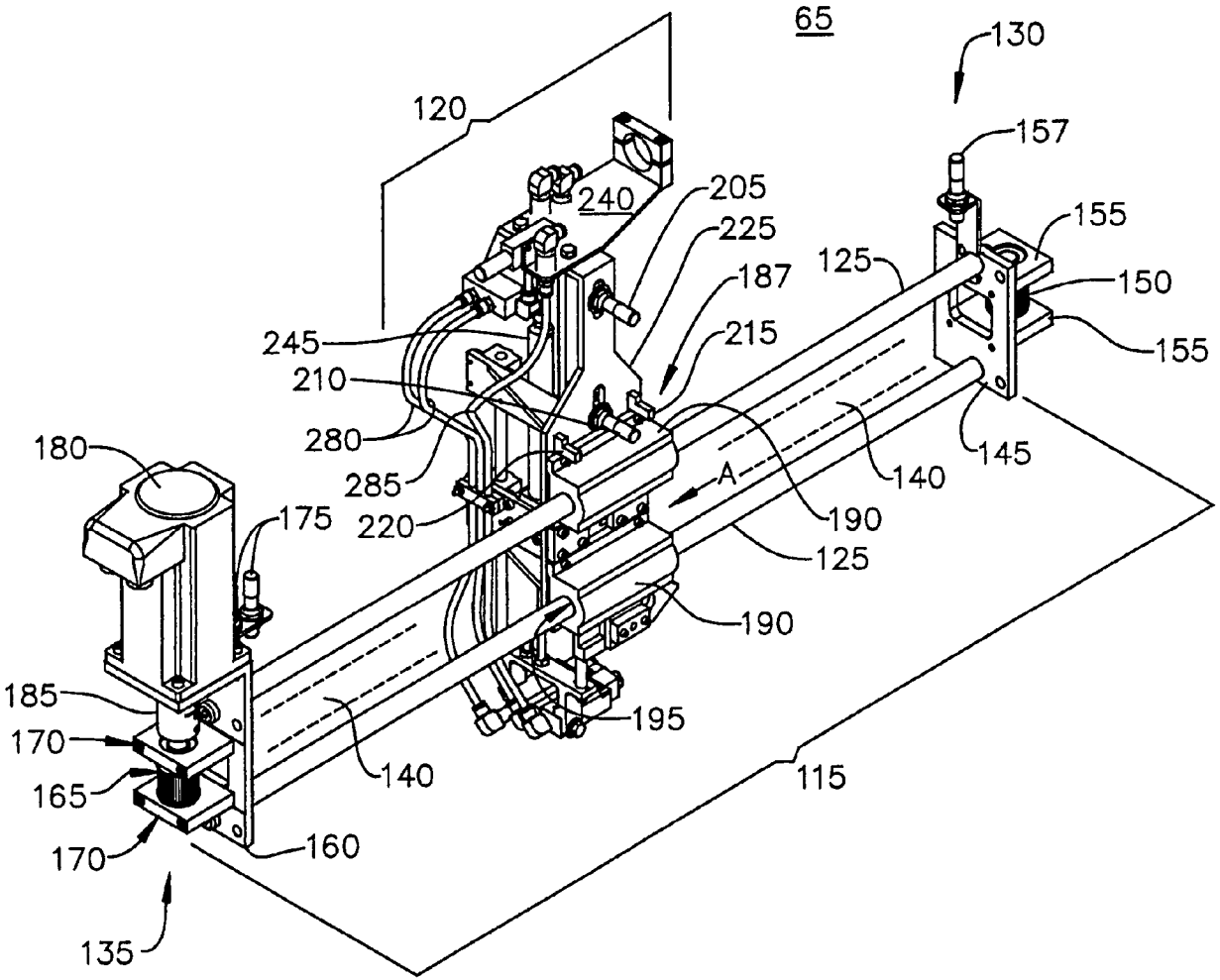
FIG. 3 is a top, rear isometric view of the one of the insert transport assemblies illustrated in FIG. 2.
Figure 4:
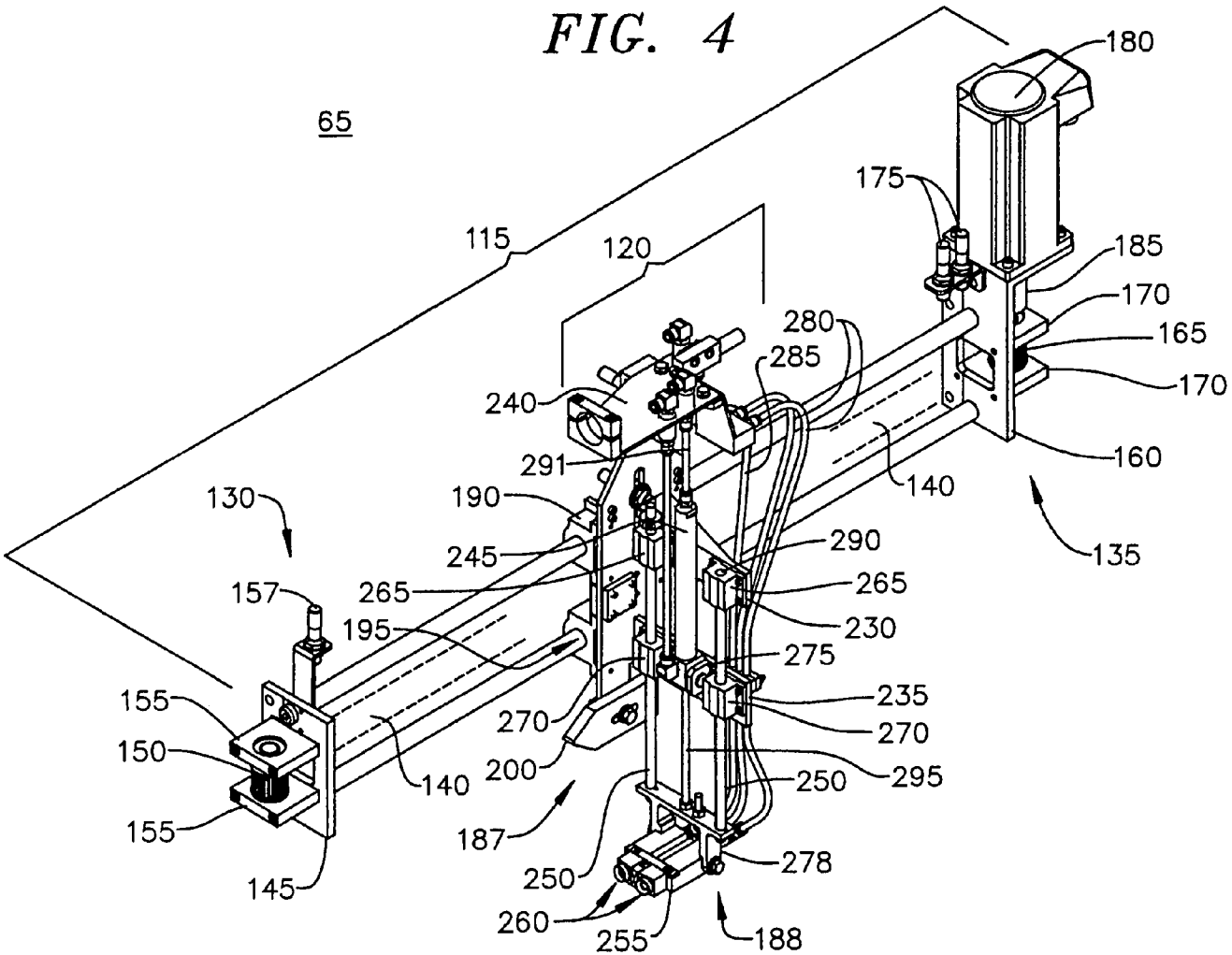
FIG. 4 is an isometric view of the same insert transport assembly shown in FIG. 3, except the insert transport assembly is viewed from the opposite direction.

To describe the main parts of the insert transport assemblies 20, 22, reference is now made to FIGS. 3 and 4. FIG. 3 is a top, rear isometric view of the one of the insert transport assemblies 65 illustrated in FIG. 2. FIG. 4 is an isometric view of the same insert transport assembly 65 shown in FIG. 3, except the insert transport assembly 65 is viewed from the opposite direction.

As shown in FIGS. 3 and 4, the insert transport assembly 65 includes a horizontal transfer assembly 115 and a vertical transfer assembly 120. The horizontal transport assembly 115 includes a pair of horizontal shafts 125, an idler end 130, a drive end 135, and a timing belt 140 (shown in phantom).

As indicated in FIGS. 3 and 4, the idler end 130 includes an idler plate 145, an idler pulley 150, idler pulley brackets 155, and a proximity sensor 157. The idler pulley 150 is pivotally interposed between the idler pulley brackets 155, which are mounted on the idler plate 145. The proximity sensor 157 is mounted on a bracket that is connected to the idler plate 145. The idler plate 145 is secured to the nester frame 90, as indicated in FIG. 2.

As indicated in FIGS. 3 and 4, the drive end 135 includes a drive plate 160, a drive pulley 165, drive pulley brackets 170, proximity sensors 175, a servo motor 180, and a coupling 185 between the servo motor 180 and the shaft of the drive pulley 165. The drive pulley 165 is pivotally interposed between the drive pulley brackets 170, which are mounted on the drive plate 160. The proximity sensors 175 are mounted on a bracket that is connected to the drive plate 160. The servomotor 180 is mounted on the drive plate 160 and drives the drive pulley 165 via the coupling 185. The drive plate 160 is secured to the nester frame 90, as shown in FIG. 2.

As shown in FIGS. 3 and 4, the horizontal shafts 125 are parallel to and separate from each other and are maintained in this configuration by the connection of their ends to the idler and drive plates 145, 160. The timing belt 140 (shown in phantom) runs parallel to and between the horizontal shafts 125, in a continuous loop around the idler and drive pulleys 150, 165.

As shown in FIGS. 3 and 4, the vertical transfer assembly 120 includes a horizontal shaft receiving assembly 187 and a vertical shaft assembly 188. The horizontal shaft receiving assembly 187 includes a pair of horizontal pillow blocks 190 having horizontal bores 195 therethrough for receiving the horizontal shafts 125, a folder opener 200 (i.e., a cam for opening a folder, which is described later in this specification), an upper proximity sensor 205, a lower proximity sensor 210, an idler side sensor target 215, a driver side sensor target 220, and a mounting plate 205 on which the pillow blocks 190, folder opener 200, proximity sensors 205, 210, and sensor targets 215, 220 are mounted.

As indicated in FIGS. 3 and 4, the timing belt 140 is secured to the mounting plate 205 at point A, between the two pillow blocks 190. As the drive pulley 165 displaces the timing belt 140 about the pulleys 150, 165, the timing belt 140 causes the vertical transfer assembly 120 to displace along the horizontal shafts 125.

As illustrated in FIGS. 3 and 4, the vertical shaft assembly 188 includes an upper plate 230, a lower plate 235, a top horizontal mounting plate 240, an air cylinder 245, a pair of vertical shafts 250, a cup holder 255 with two vacuum cups 260, an upper pair of pillow blocks 265, a lower pair of pillow blocks 270, a trunnion 275, a cup holder bracket 278, a pair of vacuum lines 280, and a compressed air line 285. As shown in FIGS. 3 and 4, the upper, lower and top horizontal mounting plates 230, 235, 240 are perpendicularly secured to the mounting plate 205. The upper pillow blocks 265 are mounted on the upper plate 230 while the lower pillow blocks 270 and the trunnion 275 are mounted on the lower mounting plate 235. Each upper and lower pillow block 265, 270 has a vertical bore 290 therethrough for receiving a vertical shaft 250, which vertically displaces through the bore 290.

As indicated in FIGS. 3 and 4, the upper end of the air cylinder 245 is connected to the top horizontal mounting plate 240 via a rigid conduit 291 and the bottom end of the air cylinder 245 is secured to the lower mounting plate 235 via the trunnion 275. The air cylinder 245 has a rod 295 that is vertically displaceable out of the bottom end of the air cylinder 245. The bottom ends of the rod 295 and the two vertical shafts 250 are connected to the top surface of the cup holder bracket 278. The cup holder 255 is secured to the cup holder bracket 278. The pair of vacuum lines 280 connects to the back of the cup holder 255 and run up the vertical shaft assembly 188 to connect to a vacuum source. The compressed air line 285 connects to the back of the cup holder 255 and runs up the vertical shaft assembly 188 to connect to a compressed air source.

As indicated in FIGS. 3 and 4, when the rod 295 extends from the air cylinder 245, the cup holder bracket 278 displaces vertically downward. Similarly, when the rod 295 is withdrawn back into the air cylinder 245, the cup holder bracket 278 displaces vertically upward. In both cases when the cup holder bracket 278 displaces vertically, the vertical shafts 250 displace through the bores 290 of the pillow blocks 265, 270. The pillow blocks 265, 270 maintain the vertical shafts 250 separate from and parallel two each other.

Figure 5:
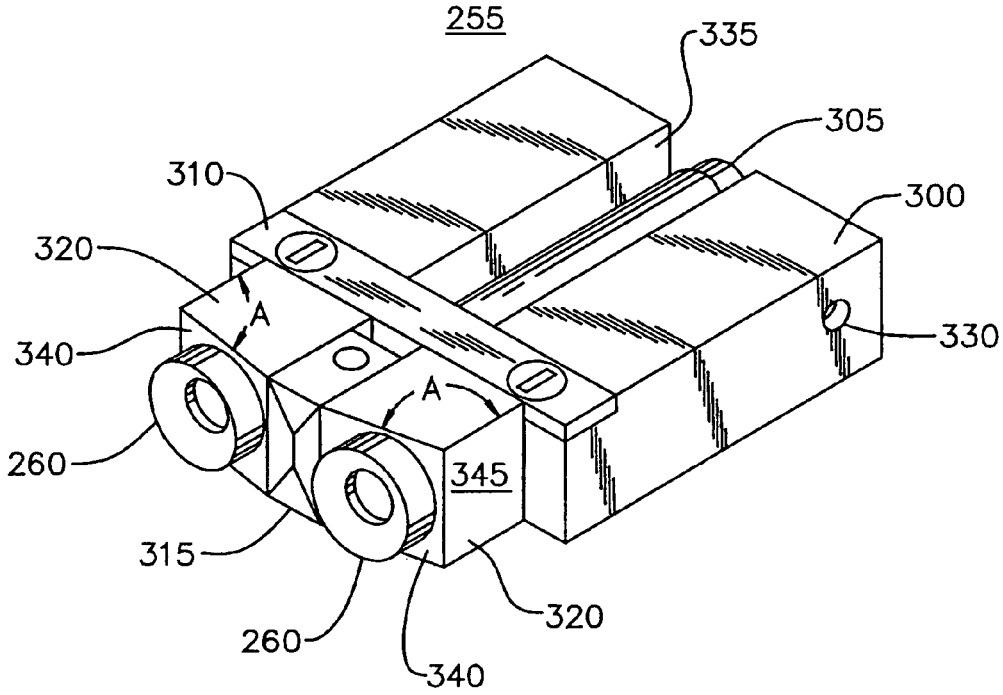
FIG. 5 is a top, front isometric view of the cup holder illustrated in FIGS. 3 and 4, with the pusher block in the retracted position.
Figure 6:
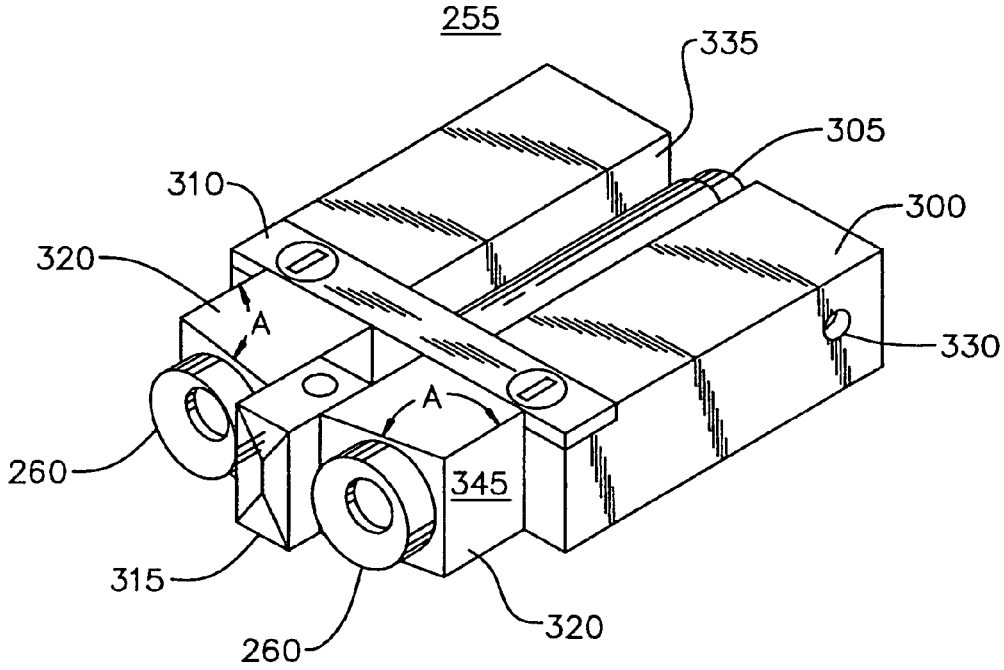
FIG. 6 is a top, front isometric view of the cup holder illustrated in FIG. 5, except the pusher block is in the extended position.

To describe the cup holder 255, reference is now made to FIGS. 5 and 6. FIG. 5 is a top, front isometric view of the cup holder 255 illustrated in FIGS. 3 and 4, with the pusher block 315 in the retracted position. FIG. 6 is a top, front isometric view of the cup holder 255 illustrated in FIG. 5, except the pusher block 315 is in the extended position.

As shown in FIGS. 5 and 6, the cup holder 255 includes a block 300, an air cylinder 305, a cylinder mount 310, a pusher block 315, a pair of cup blocks 320, a rod, and a pair of vacuum cups 260. The block 300 has mounting holes 330 for securing the block 300 to the cup holder bracket 278. The block 300 also has a longitudinal slot 335 in which the air cylinder 305 is located. The cylinder mount 310 secures the air cylinder 305 to the block 300 in the longitudinal slot 335.

As illustrated in FIGS. 5 and 6, each vacuum cup 260 is mounted in a cup block 320. As indicated in FIGS. 5 and 6, the front face 340 of each cup block 320 is not perpendicular with respect to its adjacent side face 345. More specifically, the angle "A" between the planes formed by the front and side faces 340, 345 is greater than 90 degrees. Consequently, the axes of the vacuum cups 260 are slightly angled away from each other so the axes are not parallel with each other.

As indicated in FIG. 6, the pusher block 315 is secured to the end of the rod, which is retractable into and extendable out of the air cylinder 305. Vacuum conduits, which interconnect the vacuum cups 260 to the vacuum lines 280 connected to the back of the block 300, pass through the cup holder 255. When the air cylinder 305 is actuated, the rod extends out of the air cylinder 305, causing the pusher block 315 to extend from between the cup blocks 320. Conversely, when the rod retracts back into the air cylinder 305, the pusher block 315 retracts back into position between the cup blocks 320.

Figure 7:
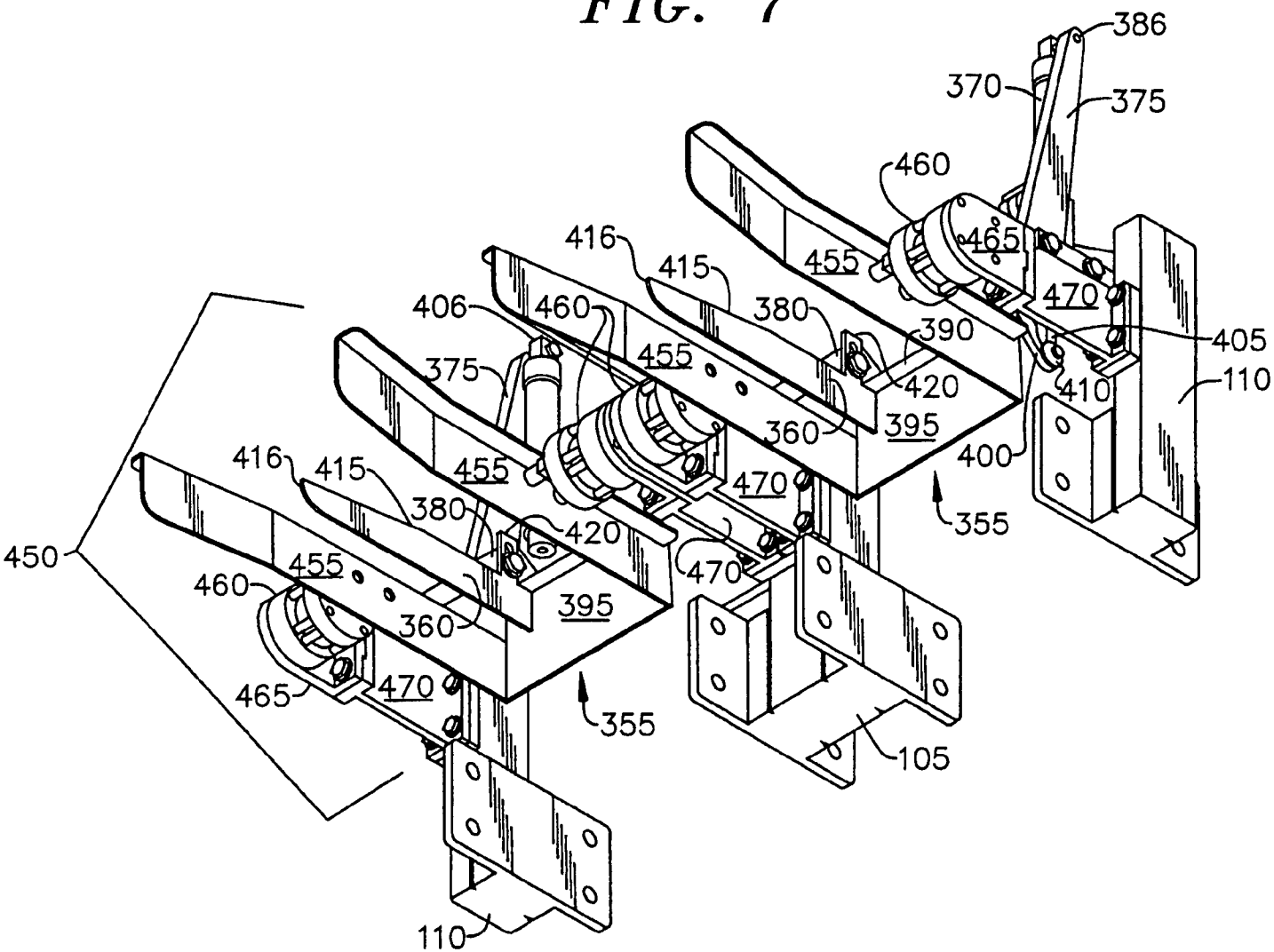
FIG. 7 is a bottom, rear isometric view of the squeeze gate/stop flap assemblies illustrated in FIG. 2.
Figure 8:
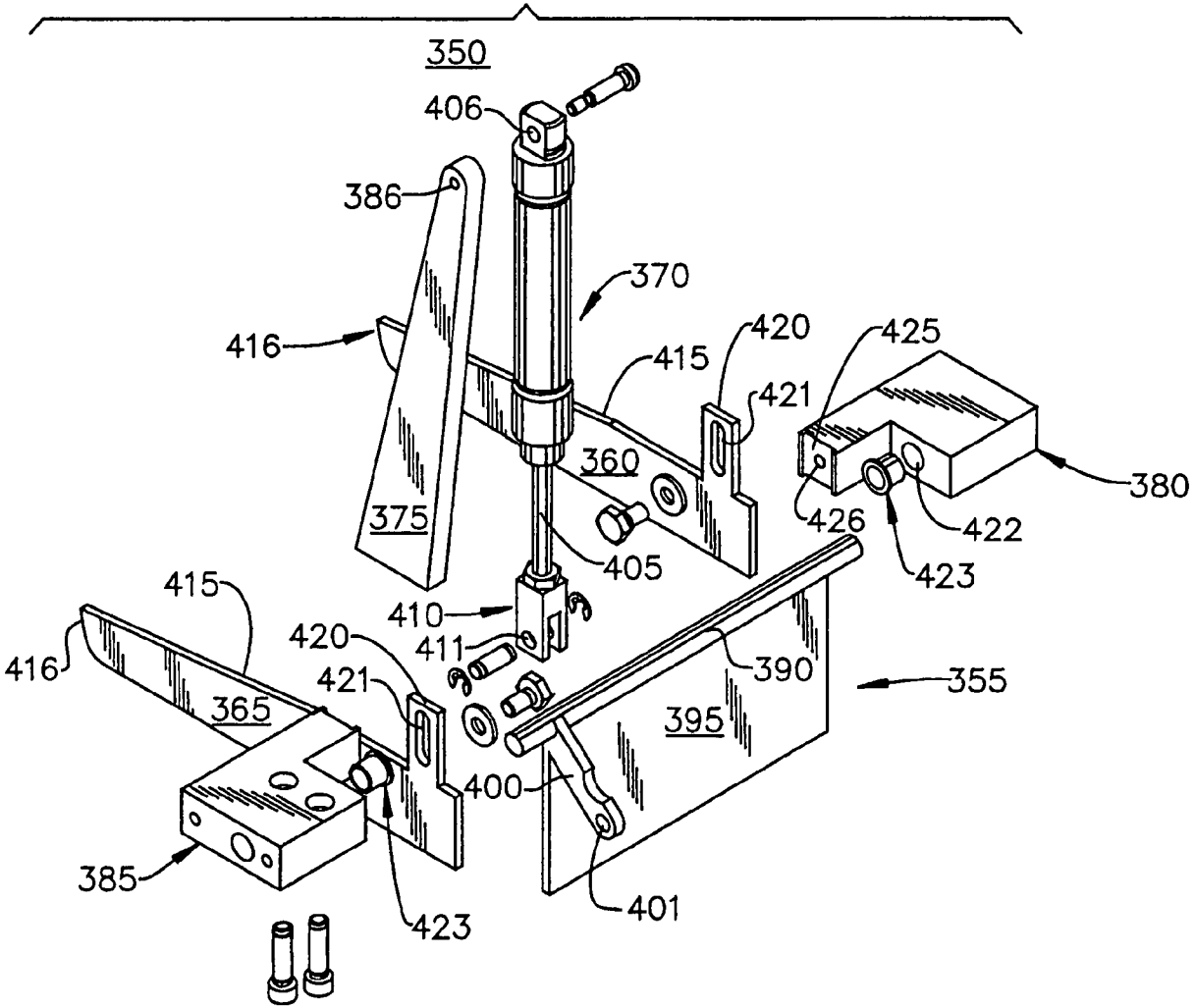
FIG. 8 is an exploded, top, front isometric view of one of the stop flap subassemblies illustrated in FIG. 7.

To describe the squeeze gate/stop flap assemblies 70, reference is now made to FIGS. 7 and 8. FIG. 7 is a bottom, rear isometric view of the squeeze gate/stop flap assemblies 70 illustrated in FIG. 2. FIG. 8 is an exploded, top, front isometric view of one of the stop flap subassemblies 350 illustrated in FIG. 7.

As shown in FIGS. 7 and 8, the stop flap subassembly 350 includes a stop flap 355, a first top guide 360, a second top guide 365, a cylinder 370, a cylinder mount 375, a first pivot mount 380, and a second pivot mount 385. The base of the cylinder mount 375 is joined to the framework of the nester assembly 20 and its peak has a bolthole 386. The stop flap 355 has a pivot bar 390, a plate 395, and an arm 400. The pivot bar 390 is joined to the top edge of the plate 395 and the arm 400 extends perpendicularly from the pivot bar 390. The arm 400 has a pinhole 401 at the arm's free end.

As indicated in FIGS. 7 and 8, a rod 405 emanates from the bottom end of the cylinder 370 while the top end of the cylinder 370 has bolthole 406, which is bolted to the bolthole 386 in the peak of the cylinder mount 375. A clevis 410 with a pinhole 411 is connected to the free end of the rod 405. The pinhole 411 of the clevis 410 is pinned to the pinhole 401 of the arm 400.

As illustrated in FIGS. 7 and 8, each top guide 360, 365 has a blade section 415 with a rounded tip 416 and a tab section 420 with a bolt slot 421. Each pivot mount 380, 385 has a pivot hole 422 for receiving a bushing 423. Also, each pivot mount 380 has a groove 425 with a bolthole 426. Each end of the pivot bar 390 pivotally rests within a bushing 423, which rests within a pivot hole 422 within a pivot mount 380, 385. The bolt slot 421 of each tab section 420 is bolted to the bolthole 426 of a pivot mount 380, each tab section 420 thereby residing within a groove 425.

As indicated in FIG. 8, when the rod 405 is in a fully extended position, the plate 395 of the stop flap 355 is in its fully down position (i.e., the plate 395 is vertical as shown in FIG. 7). Thus, when the plate 395 is in the fully down position, it prevents taco shells from moving along the nester belt 25, causing the taco shells to accumulate at the plate 395. As indicated in FIG. 8, when the rod 405 is in the fully retracted position, the plate 395 of the stop flap 355 is in its fully up position (i.e., the plate is nearly horizontal). Therefore, when the plate 395 is in the fully up position, taco shells are free to move past the plate 395 on the nester belt 25 and do not accumulate at the plate 395. As indicated in FIGS. 7 and 8, when taco shells are accumulating at a plate 395 in the fully down position, the top guides 360 facilitate the taco shells nesting within each other by preventing the taco shells from piling on top of each other.

As shown in FIG. 7, each squeeze gate subassembly 450 includes opposing squeeze gates 455, opposing air cylinders 460, cylinder mounting plates 465, and cylinder mounts 470. As illustrated in FIG. 7, each squeeze gate 455 is mounted on an air cylinder 460, which is mounted on a cylinder mounting plate 465. Each cylinder mounting plate 465 is mounted on a cylinder mount 470, which is secured to a forward or outside support 105, 110.

As indicated in FIG. 7, when taco shells begin to nest within each other at the plate 395, forming a group of nested taco shells, the opposing air cylinders 460 extend, causing the opposing squeeze gates 455 to converge. The convergence of the opposing squeeze gates 455 squares the group of nested taco shells (i.e., prevents the taco shells in the nested group from skewing with respect to each other). Once the group of nested taco shells has been squared, the opposing air cylinders 460 retract, causing the opposing squeeze gates 455 to displace away from each other, the squeeze gates 455 thereby returning to their original positions. As indicated in FIG. 7, when a group of nested taco shells is being squared by the opposing squeeze gates 455, the top guides 360 facilitate the squaring of the taco shell group by preventing the taco shell group from displacing upwards during the squaring.

Figure 9:
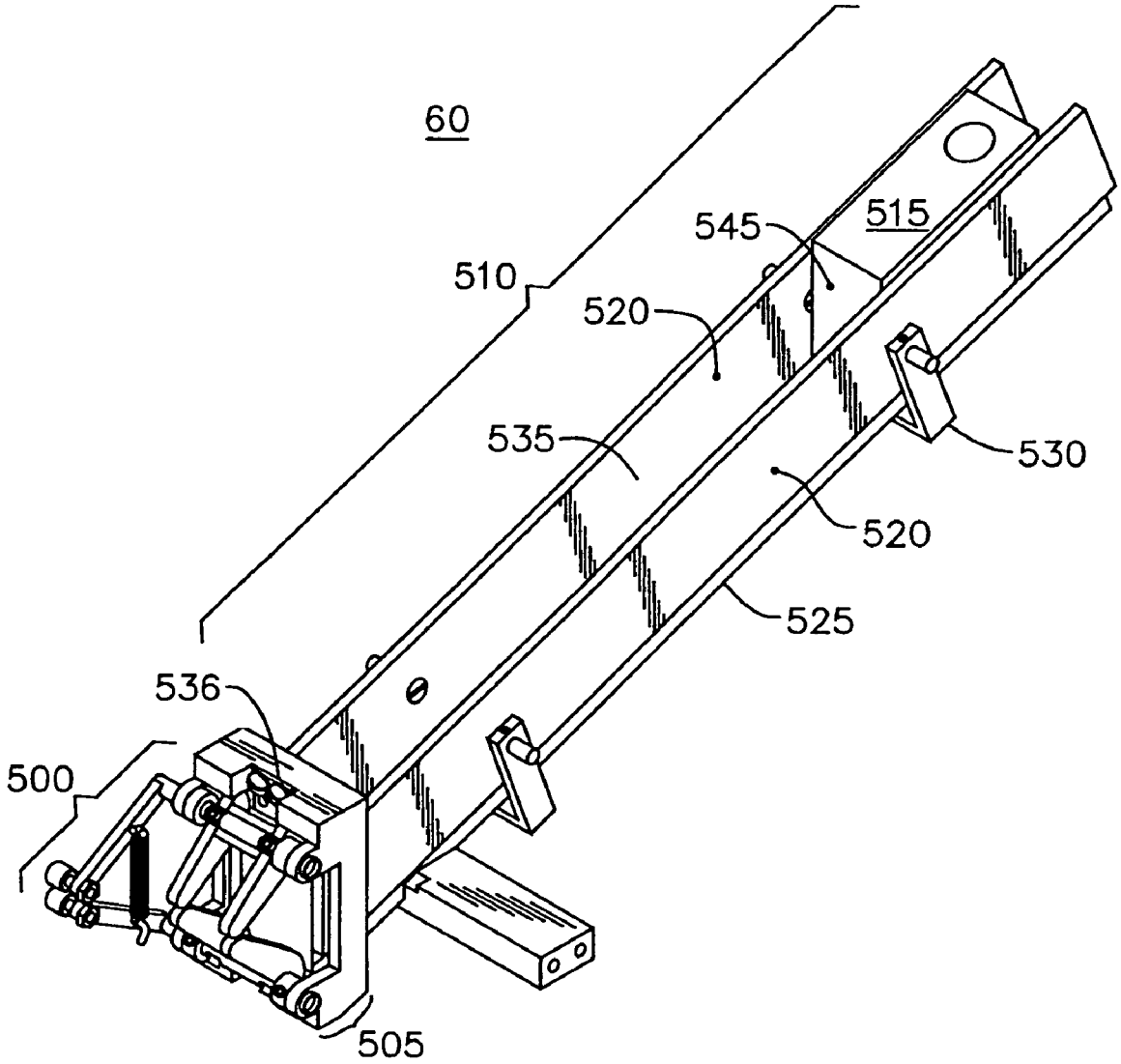
FIG. 9 is a top, rear isometric view of the insert magazine illustrated in FIG. 2.
Figure 10:
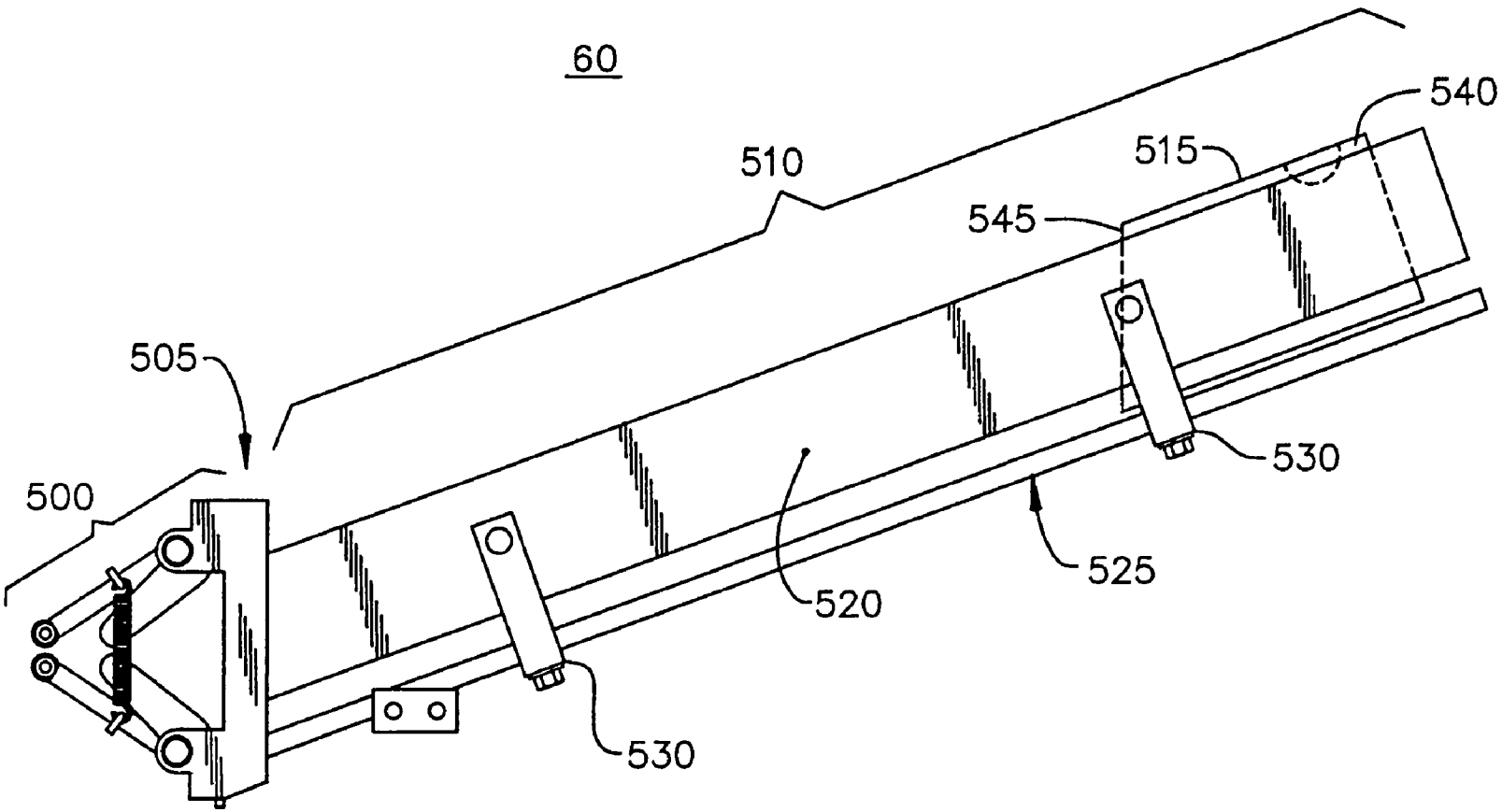
FIG. 10 is a side elevation view of the insert magazine illustrated in FIG. 9.

To describe the insert magazine 60, reference is now made to FIGS. 9 and 10. FIG. 9 is a top, rear isometric view of the insert magazine 60 illustrated in FIG. 2. FIG. 10 is a side elevation view of the insert magazine 60 illustrated in FIG. 9.

As shown in FIGS. 9 and 10, the insert magazine 60 includes a folder assembly 500, a front frame 505, a magazine 510, and a slide block 515. The magazine 510 includes two side plates 520, a bottom plate 525, and support framework 530. The plates 520, 525 are secured in place by the support framework 530 to form a channel 535 for receiving inserts. The channel 535 has an open top.

As indicated in FIGS. 9 and 10, the front frame 505 is connected to the bottom end of the magazine 510. During operation, a stack of inserts is placed in the channel 535 for individual, sequential removal by the vacuum cups 260 of the cup holder 255. The stack of inserts is retained in place by a stop 536 that extends from the front frame 505 into the pathway of the inserts.

As illustrated in FIGS. 9 and 10, the slide block 515 is movably located within the channel 535. In one embodiment of the invention, the slide block 515 has roller pins or cam followers 540 extending from the sides of the slide block 515. The cam followers 540 roll or slide against the top surface of the side plates 520, allowing the slide block 515 to displace down the channel 535 via gravity or a mechanical force, such as a spring, pneumatic or hydraulic cylinder, gear and gear racks, lever arm, linkage, or cable and pulleys.

The front face 545 of the slide block 515 is angled to present a surface that is parallel to the surface presented by the front frame 505. The slide block 515 forces the stack of inserts within the magazine 510 against the stop 536. As the inserts are individually pulled past the stop 536 by the cup holder 255, the slide block 515 progresses down the magazine 510, eventually reaching the stop 536 when all of the inserts have been removed from the magazine 510. The open top of the channel 535 and the angled face 545 of the slide block 515 combine to allow access to jams in the magazine 510.

Figure 11:
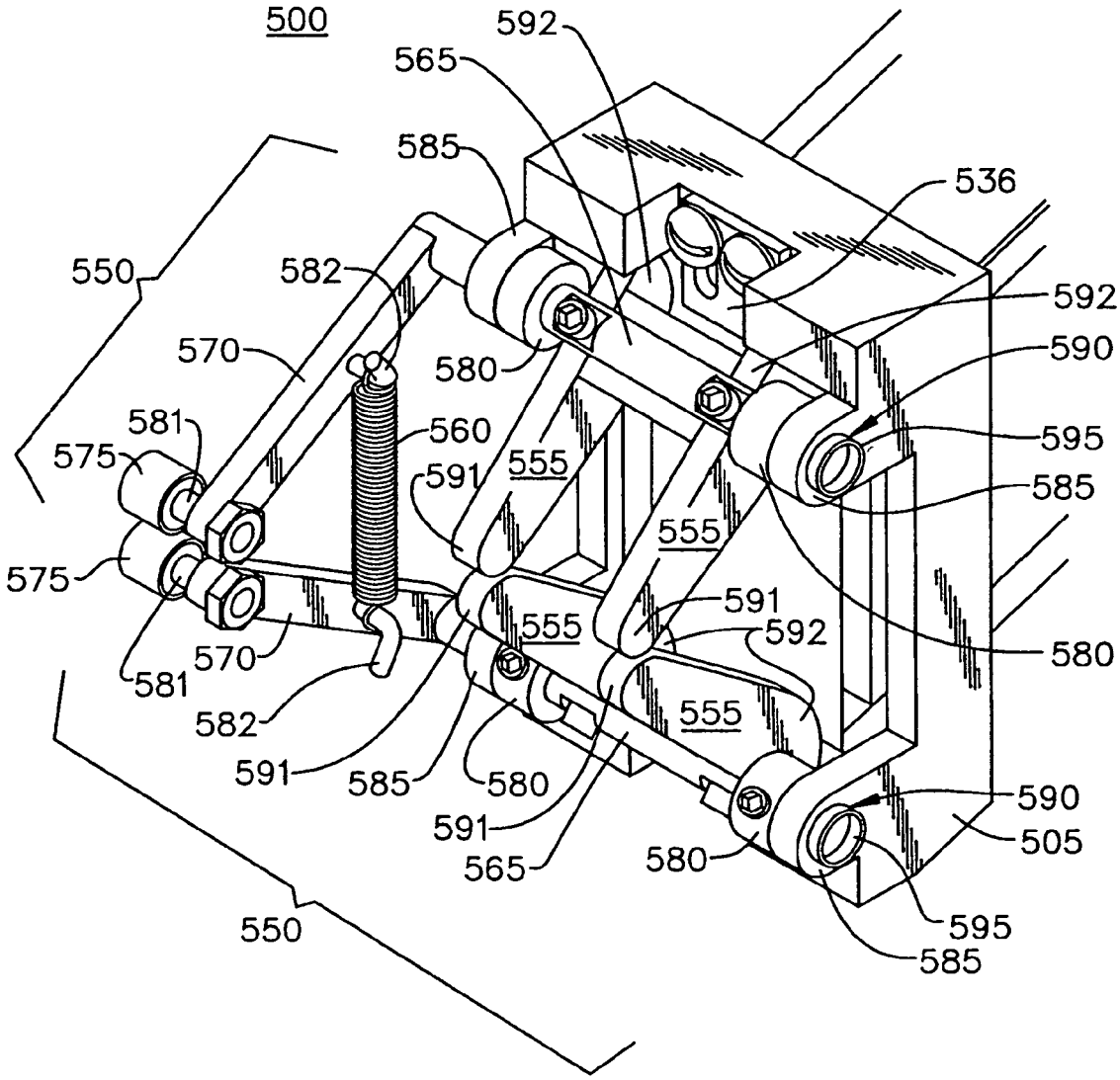
FIG. 11 is an enlarged view of the folder assembly illustrated in FIG. 9.

To describe the folder assembly 500, reference is now made to FIG. 11. FIG. 11 is an enlarged view of the folder assembly 500 illustrated in FIG. 9. As shown in FIG. 11, the folder assembly 500 includes upper and lower folder arms 550, upper and lower folder fingers 555, and a spring 560. Each folder arm 550 includes a pivot shaft 565, a lever arm 570, a cam follower 575, and a pair of set collars 580. A first end of each lever arm 570 is perpendicularly joined to an end of a pivot shaft 565. A cam follower 575 is pivotally mounted on a follower shaft 581 that is perpendicularly secured to a second end of each lever arm 570. The longitudinal axis of each follower shaft 581 is parallel to the longitudinal axis of each pivot shaft 565. A hook 582 is connected to each lever arm 570, approximately midway between the first and second ends of the lever arm 570.

As illustrated in FIG. 11, the front frame 505 has a pairs of upper and lower tabs 585. Each tab 585 has a pivot hole 590 that contains a bushing 595. The pivot shaft 565 of the upper folder arm 550 pivotally rests within bushings 595 that reside in the pair of upper tabs 585. Likewise, the pivot shaft 565 of the lower folder arm 550 pivotally rests within bushings 595 that reside in the pair of low tabs 585. A pair of set collars 580 are secured to each pivot shaft 565 so each collar 580 abuts against the side of a tab 585, thereby preventing the lateral displacement of the pivot shaft 565 within the pivot holes 590 of the tabs 585.

As shown in FIG. 11, each folder finger 555 has a rounded tip 591 and a back 592. A pair of folder fingers 555 is perpendicularly secured to each pivot shaft 565 of each folder arm 550, near the back 592 of each folder finger 555. A spring 560, the ends of which are connected to the hooks 582 on the lever arms 570, maintains the folder assembly 500 in a closed position as reflected in FIG. 11. When the folder assembly 500 is in a closed position, the upper and lower pairs of folder fingers 555 and the upper and lower lever arms 570 are radially positioned about the longitudinal axes of their respective upper and lower pivot shafts 565 such that the upper pair of tips 591 abuts with the lower pair of tips 591 and the upper cam follower 575 nearly abuts with the lower cam follower 575, leaving a small open space between the opposing surfaces of the cam followers 575.

As indicated in FIG. 11, when the cup holder 255 (shown in FIG. 4) approaches the folder assembly 500 to remove an insert from the insert magazine 60, the tip of the folder opener 200 (shown in FIG. 4) enters the space between the opposing surfaces of the cam followers 575. As the folder opener 200 continues to displace in the direction of the folder assembly 500, the upper cam follower 575 and the lower cam follower 575 travel along the upper and lower tapered surfaces of folder opener 200, respectively. Since the upper and lower tapered surfaces of the folder opener 200 diverge as one travels from the tip of the folder opener 200 to its back, the radial distance between the upper and lower cam followers 575 increases, thereby causing the upper and lower lever arms 570 to rotate their respective pivot shafts 565 about their longitudinal axes. As the pivot shafts 565 rotate about their longitudinal axes, the pairs of folder fingers 555 radial displace about the longitudinal axes of the pivot shafts 565, thereby increasing the radial displacement between the pairs of opposing tips 591.

Once the cup holder 255 has retrieved an insert from the insert magazine 60, it will begin to retract away from the folder assembly 500. The cam followers 575 will then travel back along the folder opener 200 to its tip, the cam followers 575 eventually converging to the point that the tips 591 of the folder fingers 555 are abutting or nearly abutting together in the closed position as indicated in FIG. 11.

As the cup holder 255 pulls the insert past the stop 536, the top and bottom edges of the insert are forced against the inside surfaces of the folder fingers 555. The convergence of the tips 591 of the folder fingers 555 causes the insert to fold together as it is removed from between the folder fingers 555 by the cup holder 255. The close configuration of the tips 591 causes the insert to over-fold so the fold angles for the insert are more acute than 90 degrees. Also, the gradual convergence of the folder fingers 555 from their backs 592 to their tips 591 results in a gradual folding process for the insert.

Figure 12:
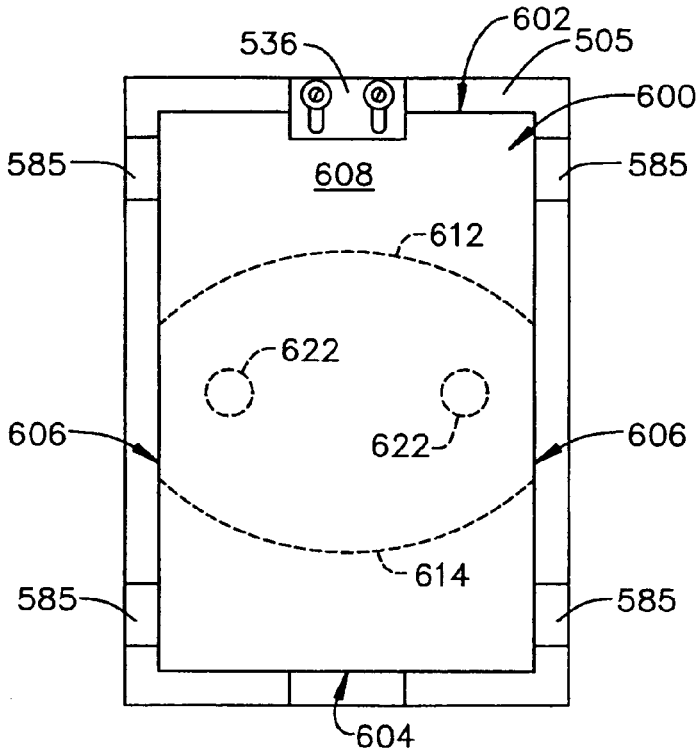
FIG. 12 is an elevation view of an insert awaiting removal from the front frame of the insert magazine, as the insert would appear to an approaching cup holder.
Figure 13:
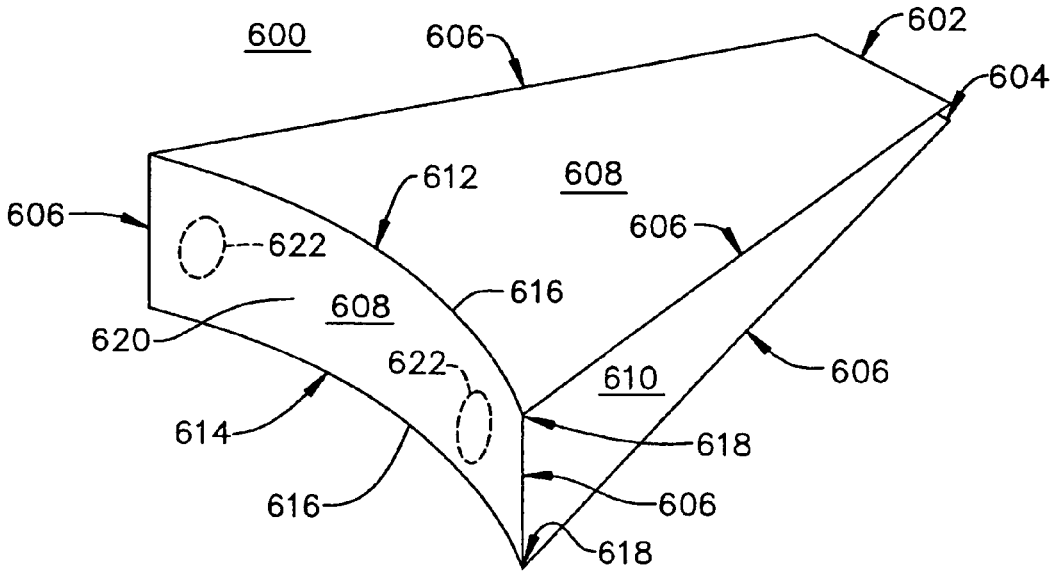
FIG. 13 is a top perspective view of the insert in its folded configuration (i.e., a folded insert) after being removed from the folding assembly.

To describe an embodiment of the insert used with the folder assembly 500, reference is now made to FIGS. 12 and 13. FIG. 12 is an elevation view of an insert 600 awaiting removal from the front frame 505 of the insert magazine 60, as the insert 600 would appear to an approaching cup holder 255. FIG. 13 is a top perspective view of the insert 600 in its folded configuration after being removed from the folding assembly 500. In other words, FIG. 13 depicts a folded insert 601.

As shown in FIG. 12, in one embodiment, the insert 600 is rectangular prior to being folded. As illustrated in FIG. 12, the insert 600, in one embodiment, has a top edge 602, a bottom edge 604, two side edges 606, a first surface 608, a second surface 610 (shown in FIG. 13), a top arcuate precut fold line 612 (shown in phantom), and a bottom precut arcuate fold line 614 (shown in phantom). The first surface 608 is the surface of the insert 600 that comes into contact with the vacuum cups 260 of the cup holder 255 and ends up being the exterior surface of the insert 600 when the insert 600 is in the folded configuration (i.e., a folded insert 601). The second surface 610 is the opposite side of the insert 600 from the first surface 608, does not come into contact with the vacuum cups 260, and ends up being the interior surface of the insert 600 when the insert 600 is in the folded configuration (i.e., a folded insert 601).

As indicated in FIGS. 12 and 13, for each precut arcuate fold line 612, 614, the insert 600 is cut on the first surface 608 of the insert 600 while the second surface 610 of the insert 600 is not intentionally cut. In one embodiment, each cut for the precut arcuate fold lines 612, 614 is a continuous unbroken cut along the path of the arcuate fold lines 612, 614, which does not completely pass through both surfaces 608, 610 of the insert 600. In another embodiment, each cut for the precut arcuate fold lines 612, 614 is a series of segmented cuts or penetrations along the path of the arcuate fold lines 612, 614, which may or may not pass completely through both surfaces 608, 610 of the insert 600. Thus, in the aforementioned embodiments and as shown in FIG. 13, when the insert 600 is folded along the arcuate fold lines 612, 614 to form a folded insert 601, the intentional precuts exist in the exterior surface 616 of the corners, not in the interior surface 618 of the corners.

As shown in FIG. 13, the arcuate fold lines 612, 614 create an arcuate back 620 for the folded insert 601. The arcuate back 620 helps to maintain the folded insert 601 in the folded configuration. The arcuate back 620 is also the motivation for the axes of the vacuum cups 260 being slightly angled away from each other so the axes are not parallel with each other, as discussed above and shown in FIGS. 5 and 6. As indicated by the phantom line circles in FIGS. 12 and 13, the vacuum cup points of contact 622 with the insert 600 and folded insert 601 are midway between the arcuate fold lines 612, 614. As the vacuum cups 260 withdraw the insert 600 from the folder assembly 500, the non-parallel axes of the vacuum cups 260 and the pressing of the push block 315 against the back 620 of the folded insert 601 help to form the arcuate back 620 as the folder fingers 555 fold the top and bottom edges 602, 604 together as illustrated in FIG. 13.

In one embodiment of the insert 600, the insert 600 is coated to facilitate the adherence of the vacuum cups 260 to the insert 600. In one embodiment, the coating is an oleophobic coating. In one embodiment, the insert 600 is over-folded so the fold angles of the resulting folded insert 601 are more acute than 90 degrees.

Figure 14:
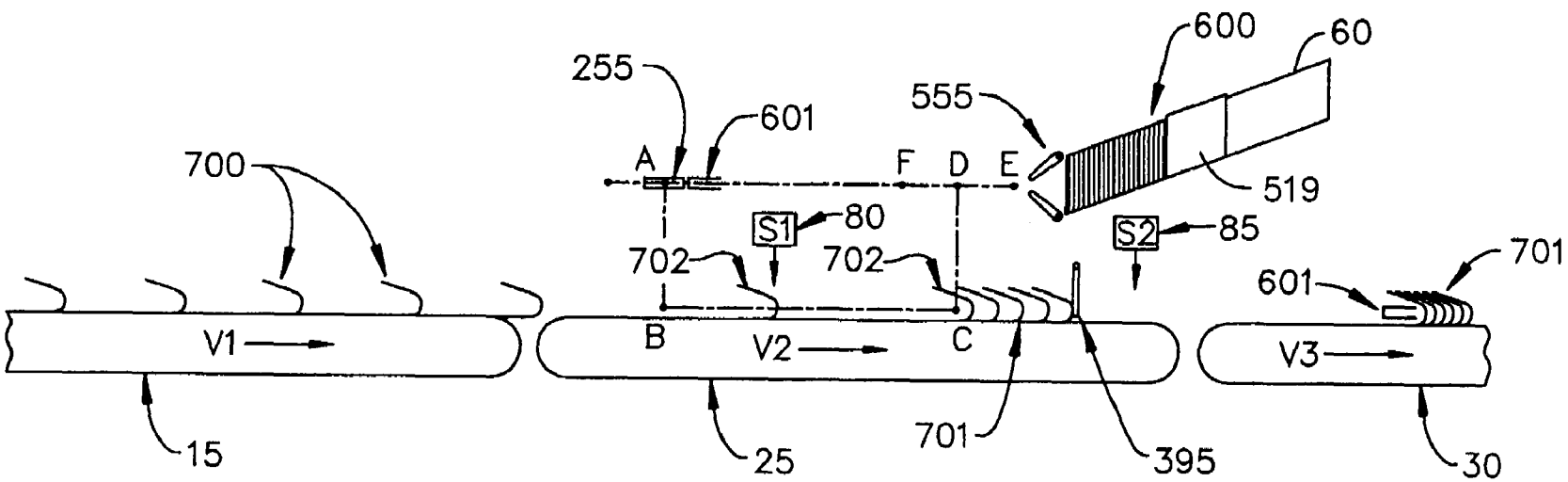
FIG. 14 is a schematic elevation view of the main assembly of the subject taco nester system.

To describe a sequence of operation for the taco nester system of the subject invention, reference is now made to FIG. 14. FIG. 14 is a schematic elevation view of the main assembly 10 of the subject taco nester system. As shown in FIG. 14, the infeed belt 15 receives taco shells 700 one at a time from a fryer. Each taco shell 700 travels along the infeed belt 15 with its closed end facing the direction of travel. The infeed belt speed V1 is constant and controlled via a variable frequency drive ("VFD"). In one embodiment of the invention, the infeed belt speed V1 is 50 feet per minute. Because the shells 700 come out of the fryer at nearly a constant speed, the spacing of the taco shells 700 on the infeed belt 15 is essentially uniform.

As indicated in FIG. 14, the shells 700 transfer from the infeed belt 15 to the nester belt 25. The nester belt speed V2 is also controlled by a VFD. The nester belt 25 has two operational speeds V2, a fast nester belt speed V2F, which is faster than the infeed belt speed V1, and a slow nester belt speed V2S, which is slower than the fast nester belt speed V2F. In one embodiment of the invention, the fast nester belt speed V2F is 70 feet per minute. Except during a specific portion of the nesting sequence when a folded insert 601 is being inserted in a nested group 701 of tacos shells 700 and the nesting belt 15 is operating at the slow speed V2S, the nester belt 15 typically operates at the fast speed V2F. Thus, when the taco shells 700 transfer from the infeed belt 15 to the nester belt 25, which is operating at the fast speed V2F, the spacing between the taco shells 700 on the nester belt 25 increases as compared to the spacing of the taco shells 700 on the infeed belt 15. The extra spacing provides more clearance between the cup holder 255 and the taco shells 700 when the nesting sequence occurs.

Referring to FIG. 14, the narration of the nesting sequence begins with the cup holder 255 holding a folded insert 601 at position "A," the plate 395 of the stop flap subassembly 350 is in the fully down position blocking the progress of taco shells 700 along the nester belt 25, the opposing squeeze gates 455 of the squeeze gate subassembly 450 are retracted against their respective air cylinders 460, and the nester belt 25 is operating at the fast speed V2F. When the cup holder 255 is in position A, the vertical transfer assembly 120 is located at a point along the horizontal shafts 125 that is near the drive plate 160, and the vertical shafts 250, from which the cup holder 255 is suspended, are retracted up so the centers of the vacuum cups 260 correspond vertically with the tip of the folder opener 200. Also, when the cup holder 255 is in position A, the pusher block 315 of the cup holder 255 is extended against the arcuate back 620 of the folded insert 601 and the vacuum for the vacuum cups 260 is enabled, thereby suspending the folded insert 601 and maintaining the folded insert 601 in the folded configuration.

The taco nester system maintains the aforementioned positioning as taco shells 700 pass under the rearward photo switch 80, which signals the passage of the taco shells 700 to the nester logic center in the control panel 35. The taco shells 700 continue traveling along the nester belt 25 and accumulate at the fully down plate 395 of the stop flap subassembly 350.

Once the nester logic center has determined that a sufficient number of taco shells 700 have passed the rearward photo switch 80 to constitute a nested group 701 of taco shells 700, the vertical shafts 250 displace the cup holder 255, with its folded insert 601, vertically downward to position "B," where the centers of the vacuum cups 260 correspond vertically with the vertical centers of the taco shells 700 accumulating at the plate 395. As the cup holder 255 displaces from position A to position B, the nester belt 25 changes from fast speed V2F to slow speed V2S. Thus, the taco shell 700 following the last taco shell 702 needed to constitute the nested group 701 does not reach the squeeze gate/stop flap assembly 70 until after the nesting sequence has been completed. For example, where the nested groups 701 consist of six taco shells 700 and the sixth (i.e., the last taco shell 702) has passed the rearward photo switch 80, the nester belt 25 shifts to slow speed V2S and the seventh taco shell 700 does not reach the squeeze gate/stop flap assembly 70 until after the nesting sequence has been completed.

At this point, the servo motor 180 causes the timing belt 140 to horizontally displace the vertical transfer assembly 120 along the horizontal shafts 125, towards the idler plate 145, at a medium speed that exceeds the slow speed V2S of the nester belt 25. This causes the cup holder 255, with its folded insert 601, to displace horizontally with and along the nester belt 25. As a result, the cup holder 255, with its folded insert 601, pursues and overtakes the last taco 702 shell to pass the rearward photo switch 80. The folded insert 601 enters the opening of the last taco shell 702, and the cup holder 255 propels the last taco shell 702 forward to nest within the preceding taco shell 700. As the cup holder 255 continues to displace horizontally along the nester belt 25, all of the taco shells 700 are nested within each other to form a nested group 701 of tacos shells 700 abutting against the fully down plate 395. As the nesting occurs at the plate 395, the top guides 360, 365 prevent the taco shells 700 from rising out of nesting alignment with each other. The cup holder 255 is now at position "C" with the vertical transfer assembly 120 being located at a point along the horizontal shafts 125 near the idler plate 145.

Once the cup holder 255 is in position C and the nested group 701 of taco shells 700 is formed, the opposing squeeze gates 455 of the squeeze gate subassembly 450 converge to square the nested group 701. As the squaring occurs, the top guides 360, 365 prevent the taco shells 700 from rising out of nesting alignment with each other.

Once the nested group 701 is fully nested and squared, the pusher block 315 is retracted, the vacuum is turned off so the vacuum cups 260 release the folded insert 601, which is frictionally engaged and retained by the last taco shell 702, and the opposing squeeze gates 455 retract against their respective air cylinders 460. The plate 395 of the stop flap subassembly 350 pivots to the fully open position, and the vertical shafts 250 displace the cup holder 255 vertically upward to position "D," where the centers of the vacuum cups 260 correspond vertically with the tip of the folder opener 200 and the vacuum is turned back on for the vacuum cups 260. At approximately the same time, the nester belt 25 shifts back to fast speed V2F, transports the nested group 701 past the forward photo switch 85, and on to the takeaway belt 30, which transports the nested group 701 to packaging. In one embodiment of the invention, the takeaway belt 30 operates at a constant speed. In one embodiment, the takeaway belt speed V3 is 50 feet per minute.

As the nested group 701 passes the forward photo switch 85, the nester logic center is notified that the nested group 701 has cleared the plate 395 of the stop flap subassembly 350. The plate 395 then pivots back to its fully down position, once again causing taco shells 700 to accumulate at the plate 395.

As indicated in FIG. 14, the servomotor 180 causes the timing belt 140 to horizontally displace the vertical transfer assembly 120 along the horizontal shafts 125, towards the idler plate 145, at a medium-slow speed. This brings the cup holder 255 to position "E" and causes the folder opener 200 to come into contact with the cam followers 575, thereby forcing the lever arms 570 apart and causing the folder fingers 555 to open sufficiently to allow the cup holder 255 to enter the folder assembly 500. As the cup holder 255 enters the folder assembly 500, the vacuum cups 260 attach to the first insert 600 exposed behind the stop 536 of the insert magazine 60. The servo motor 180 then reverses direction and causes the timing belt 140 to horizontally displace the vertical transfer assembly 120 along the horizontal rails 125, at a slow speed, as the cup holder 255 returns to position D.

As the cup holder 255 returns to position D, the folder opener 200 retreats from contact with the cam followers 575, gradually allowing the folder fingers 555 to close on the insert 600 as it is being removed from the folder assembly 500 and folded into a folded insert 601. At approximately the same time, the pusher block 315 is extended against the back 620 of the insert 600 by the air cylinder 305 located on the cup holder 255. Due to the geometry of the precut arcuate fold lines 612, 614, the arrangement of the axes of the vacuum cups 260, and the pressure applied against the back 620 by the pusher block 315, the folded insert 601 remains in the folded configuration. This folding process results in a gradual folding motion. It also results in the folded insert 601 being over-folded. Thus, the fold angles are more acute than 90 degrees. As each insert 600 is removed from the insert magazine 60 by the cup holder 255, the magazine block 515 forces another insert 600 into position for removal.

As indicated in FIG. 14, the servomotor 180 then causes the timing belt 140 to horizontally displace the vertical transfer assembly 120 along the horizontal shafts 125, towards the drive plate 160, at a high speed. This brings the cup holder 255, with its attached folded insert 601, back to position A. The nesting sequence is now ready to repeat once the nester logic center determines a sufficient number of taco shells 700 have passed the rearward photo switch 80.

Those skilled in the art will recognize that the servomotor 180 and the timing belt 140 provide the taco shell nester system of the subject invention with the ability to break the horizontal motion of the cup holder 255 into controllable segments. Specifically, because of the servo motor 180 and the timing belt 140, the horizontal positioning of the cup holder 255 at positions A, B, C, D, E, and F may be easily reprogrammed, by pushing a single button on the control panel 35, to allow for nested groups 701 of taco shells of different counts (e.g., nested groups 701 having six, 12, or 18 taco shells 700). For instance, by programming positions C and D to be closer to the idler end 130, the taco nester system can produce six count nested groups 701 of taco shells 700. Similarly, by programming the positions of C and D to be closer to the drive end 135, the taco nester system can produce 12 or 18 count nested groups 701 of taco shells 700. Other count nested groups 701 of taco shells 700 are possible depending on the locations of positions C and D.

Because of the servomotor 180 and the timing belt 140, the speed at which the cup holder 255 travels horizontally between positions A, B, C, D, E, and F can be programmed and controlled individually. For example, the cup holder 255 travels horizontally between positions B and C at a medium speed, between positions D and E at a medium-slow speed, between positions E and F at a slow speed, and between positions F and A at a high speed.

Although the present invention has been described with reference to preferred embodiments, persons skilled in the art will recognize that changes may be made in form and detail without departing from the spirit and scope of the invention.

We claim:

1. A method for placing an insert within an open end of a taco shell, the method comprising:

removing with a vacuum cup an insert from a folding assembly of a folded insert magazine, wherein the vacuum cup moves in a first direction horizontally at a first speed; and moving the vacuum cup horizontally in the first direction at a second speed that is greater than the first speed after the insert has been removed from the insert magazine;

providing a taco shell having an open end; and placing the folded insert within the open end of the taco shell.

2. The method of claim 1 further comprising horizontally moving the vacuum cup in a second direction at a third speed to approach the insert presented at the folding assembly, wherein the third speed is at least equal to the first speed.

3. The method of claim 1 further comprising moving the vacuum cup vertically.

4. The method of claim 3 further comprising moving the vacuum cup horizontally in a second direction.

5. A method for nesting individual taco shells to form a nested group of taco shells, the method comprising:

operating a nester conveyor at a first speed;

sensing a plurality of individual taco shells being transported to a nesting station;

causing the nester conveyor to operate at a second speed after having sensed a predetermined number of the plurality of individual taco shells, wherein the second speed is less than the first speed;

forming a nested group of taco shells from the predetermined number of the plurality of individual taco shells;

sensing the nested group of taco shells passing from the nesting station; and causing the nested conveyor to shift from the second speed to the first speed when the passage of the nested group from the nested station has been sensed.

6. A method for nesting individual taco shells to form a nested group of taco shells, the method comprising:

operating a nester conveyor at a first operational speed;

sensing a plurality of individual taco shells being transported to a nesting station;

causing the nester conveyor to operate at a second operational speed after having sensed a predetermined number of the plurality of individual taco shells, wherein the second operational speed is less than the first operational speed;

forming a nested group of taco shells from the predetermined number of the plurality of individual taco shells; and operating an infeed conveyor, which is adapted to feed taco shells to the nester conveyor, at an operational speed that is less than the first operational speed of the nester conveyor.

7. A method for nesting individual taco shells to form a nested group of taco shells and for placing an insert within an open end of one of the individual taco shells, the method comprising:

operating a nester conveyor at a first speed;

providing a plurality of taco shells, each of the plurality of taco shells having an open end;

moving the plurality of taco shells along the nester conveyor;

sensing the individual ones of the plurality taco shells moving along the nester conveyor to a nesting station;

causing the nester conveyor to operate at a second speed after having sensed a predetermined number of the plurality of taco shells, wherein the second speed is less than the first speed;

forming a nested group of taco shells from the predetermined number of the plurality of taco shells;

removing with a vacuum cup an insert from a folding assembly of a folded insert magazine, wherein the vacuum cup moves in a first direction horizontally at a first speed;

moving the vacuum cup horizontally in the first direction at a second speed that is greater than the first speed after the insert has been removed from the insert magazine; and placing the folded insert within the open end of a last one of the nested group of taco shells.

* * * * *